US010294796B2

(12) United States Patent
Li et al.

(10) Patent No.: US 10,294,796 B2
(45) Date of Patent: May 21, 2019

(54) BLADE OR VANE ARRANGEMENT FOR A GAS TURBINE ENGINE

(71) Applicant: Siemens Aktiengesellschaft, Munich (DE)

(72) Inventors: Yan Sheng Li, North Hykeham (GB); Roy Teuber, Hartmannsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 630 days.

(21) Appl. No.: 14/911,752

(22) PCT Filed: Jul. 29, 2014

(86) PCT No.: PCT/EP2014/066259
§ 371 (c)(1),
(2) Date: Feb. 12, 2016

(87) PCT Pub. No.: WO2015/024741
PCT Pub. Date: Feb. 26, 2015

(65) Prior Publication Data

US 2016/0273362 A1 Sep. 22, 2016

(30) Foreign Application Priority Data

Aug. 23, 2013 (GB) ..... 1315078.4

(51) Int. Cl.
*F01D 5/30* (2006.01)
*F01D 5/14* (2006.01)
(Continued)

(52) U.S. Cl.
CPC ..... *F01D 5/145* (2013.01); *F01D 5/143* (2013.01); *F01D 5/187* (2013.01); *F01D 9/041* (2013.01);
(Continued)

(58) Field of Classification Search
CPC ..... F01D 5/143; F01D 5/145
See application file for complete search history.

(56) References Cited

U.S. PATENT DOCUMENTS 7,625,181 B2 * 12/2009 Matsuda ..... F01D 5/145 415/191
8,105,037 B2 * 1/2012 Grover ..... F01D 5/143 416/179
(Continued)

FOREIGN PATENT DOCUMENTS

CN 1847623 A 10/2006
CN 101775999 A 7/2010
(Continued)

OTHER PUBLICATIONS

CN Office Action dated Aug. 9, 2016, for CN application No. 201480046310.5.
(Continued)

*Primary Examiner* — Woody A Lee, Jr.
*Assistant Examiner* — Jason A Fountain
(74) *Attorney, Agent, or Firm* — Beusse Wolter Sanks & Maire

(57) ABSTRACT

A blade or vane arrangement for a gas turbine engine has an array of aerofoils mounted to respective platforms about an axis and defining a passage through which a working gas flow passes. The arrangement has a datum and the aerofoil has a radial span. Each aerofoil has pressure side, a suction side, a leading edge region and a leading edge foot extending from the leading edge region, the leading edge foot has a ridge line. The platform defines a channel and a platform leading edge, the channel has a minimum radial height line, and the platform leading edge partly defines an outlet through which a secondary flow passes. The ridge line is aligned generally in the direction of the working gas flow
(Continued)

and the minimum radial height line is aligned generally in the direction of the secondary flow.

22 Claims, 9 Drawing Sheets

(51) Int. Cl.
*F01D 5/18* (2006.01)
*F01D 9/04* (2006.01)
*F01D 25/12* (2006.01)

(52) U.S. Cl.
CPC ..... *F01D 25/12* (2013.01); *F05D 2220/32* (2013.01); *F05D 2240/121* (2013.01); *F05D 2240/303* (2013.01)

(56) References Cited

U.S. PATENT DOCUMENTS

| | | | | |
|---|---|---|---|---|
| 8,186,952 | B2 * | 5/2012 | Tibbott | F01D 5/081 415/115 |
| 8,192,154 | B2 | 6/2012 | Sonoda et al. | |
| 8,459,956 | B2 * | 6/2013 | Pandey | F01D 5/143 416/190 |
| 9,140,128 | B2 * | 9/2015 | Aggarwala | F01D 5/143 |
| 2004/0081548 | A1 | 4/2004 | Zess et al. | |
| 2006/0153681 | A1 | 7/2006 | Lee et al. | |
| 2006/0233641 | A1 | 10/2006 | Lee et al. | |
| 2007/0081898 | A1 * | 4/2007 | Matsuda | F01D 5/145 416/193 A |
| 2009/0035130 | A1 | 2/2009 | Hasenjaeger et al. | |
| 2009/0280011 | A1 * | 11/2009 | Tibbott | F01D 5/081 416/95 |
| 2010/0080708 | A1 | 4/2010 | Gupta et al. | |
| 2010/0158696 | A1 * | 6/2010 | Pandey | F01D 5/143 416/243 |
| 2010/0166558 | A1 | 7/2010 | Siden et al. | |
| 2010/0254797 | A1 * | 10/2010 | Grover | F01D 5/143 415/1 |

FOREIGN PATENT DOCUMENTS

| | | | |
|---|---|---|---|
| DE | 102007020025 | A1 | 10/2008 |
| EP | 1712737 | A1 | 10/2006 |
| EP | 1731712 | A1 | 12/2006 |
| EP | 1074697 | B1 | 1/2008 |
| EP | 2204535 | A2 | 7/2010 |
| EP | 2317077 | A2 | 5/2011 |
| GB | 2501969 | A | 11/2013 |
| JP | 2012132463 | A | 7/2012 |
| WO | 0061918 | A2 | 10/2000 |
| WO | 201300449 | A1 | 1/2013 |

OTHER PUBLICATIONS

Lynch, Stephen et al, "Flow and Thermal Performance of a Gas Turbine Nozzle Guide Vane With a Leading Edge Fillet", Mechanical Engineering, Virginia Tech., pp. 1-10.

Hoeger, Martin et al, "Impact of a Fillet on Diffusing Vane Endwall Flow Structure", The 11th International Symposium on Transport Phenomena and Dynamics of Rotating Machinery, Feb. 26-Mar. 2, 2006, ISROMAC 2006-057; pp. 1-11, Honolulu, Hawaii, US.

Zess, G. A. et al, "Computational Design and Experimental Evaluation of Using a Leading Edge Fillet on a Gas Turbine Vane", Journal of Turbomachinery, Apr. 2002, vol. 124, pp. 167-175.

Sumanta, Acharya et al, "Turbine Blade Aerodynamics", Louisiana State University, CEBA 1419B, Mechanical Engineering Department, pp. 363-390, Baton Rouge, LA, US.

* cited by examiner

BLADE OR VANE ARRANGEMENT FOR A GAS TURBINE ENGINE

CROSS REFERENCE TO RELATED APPLICATIONS

This application is the US National Stage of International Application No. PCT/EP2014/066259 filed Jul. 29, 2014, and claims the benefit thereof. The International application claims the benefit of Great Britain Application No. GB 1315078.4 filed Jul. 29, 2014. All of the applications are incorporated by reference herein in their entirety.

FIELD OF INVENTION

This invention relates to a blade or vane arrangement and in particular, an aerofoil and platform configuration of a rotor blade or a stator vane, particularly but not exclusively, for a gas turbine engine.

BACKGROUND OF INVENTION

In a turbine engine, compressors and turbines typically have axially arranged and alternate sets or stages of rotor blades and stator vanes. The stator vanes are mounted to a casing and the rotor blades are mounted to rotor discs. The rotor blades and stator vanes each comprise aerofoils mounted on platforms and the surfaces of which define a working gas flow passage.

The efficiency of the engine is strongly influenced by the shape and the configuration of the aerodynamic surfaces of the rotor blades and stator vanes. The behaviour of the main working gas flow through the compressor and turbine is highly complex and can vary dependent on the engine output, the input of secondary gas flows to the main working gas flow and locally throughout the gas flow passage.

For turbines in particular, additional complexity in the working gas flow can arise from the temperature traverse of the working gas flow from the combustor and thermal characteristics of the turbine blades and stator vanes. Numerous attempts have been made to optimise certain aspects of blade and vane designs to improve stage efficiency and thermal management of the gas flow passage surfaces.

WO0061918A2 discloses a vortex elimination device disposed at the intersection of a blade or vane and its endwall or platform. The vortex elimination device has a generally triangular shape with a straight or curvilinear leading edge and is integral with or attached to the airfoil and endwall. The vortex elimination device prevents the formation of a leading edge vortex as the flow stream passes over the leading edge of the airfoil by generating a radial leading edge force that counters the radial equilibrium and stagnated flow forces, thereby providing a smooth flow stream around the airfoil leading edge.

EP1074697 A2 discloses a method for inhibiting radial transfer of core gas flow away from a center radial region and toward the inner and outer radial boundaries of a core gas flow path. A flow directing structure includes an airfoil having a fillet which diverts the core gas flow away from the area where the airfoil abuts the end wall. Increasing the velocity of the core gas flow in the area where the leading edge of the airfoil abuts the wall impedes the formation of a pressure gradient along the surface of the airfoil that forces core gas from the center region of the core gas toward the wall.

In "Turbine Blade Aerodynamics", by Sumanta Acharya & Gazi Mahmood, Louisiana State University, CEBA 1419B, Mechanical Engineering Department, pages 363-390 there is disclosed a Leading Edge Fillet or leading edge contouring near the endwall. Fillets are placed at the junction of the leading edge and endwall. Two types of basic construction of fillet profiles can be identified: (i) profile with varying height from the blade surface to the endwall and (ii) profile of bulb with surface thickness at the outer periphery.

However, none of these documents address the problems associated with from the interaction of the main working gas flow and secondary or leakage flow egressing immediately upstream of a set of rotor blades or stator vanes.

SUMMARY OF INVENTION

One objective or advantage of the present invention is to improve the efficiency of a blade or vane arrangement. Another objective is to reduce or eliminate aerodynamic losses incurred from the interaction of the main working gas flow and secondary or leakage flow. Another objective is to reduce or eliminate horseshoe vortices formed at or near the leading edge of an aerofoil. Another objective is to improve the working gas flow streamlines so they are significantly more linear and smoother. Another objective is to create a more aerodynamically efficient aerofoil and platform arrangement for improving overall engine efficiency.

Another objective is to reduce or eliminate cross passage secondary or leakage flow particularly from the pressure side to the suction side.

Another objective or advantage of the present invention is a reduction in blade front aerodynamic loading and a more favourable pressure gradient that reduces the cross passage flow of the main working gas. Yet another advantage to reducing cross-passage secondary flow is that coolant remains attached to the platform surface much further downstream rather than being swept across the passage relatively early in a conventional design. This gives an improved benefit to blade platform cooling and a reduction in the amount of heat put into the aerofoil.

For these and other objectives and advantages there is provided a blade or vane arrangement for a gas turbine engine. The arrangement having an array of aerofoils mounted to respective platforms about an axis and defining a passage through which a working gas flow passes. The arrangement has a datum and the aerofoil has a radial span. Each aerofoil has pressure side, a suction side, a leading edge region and a leading edge foot extending from the leading edge region, the leading edge foot has a ridge line. The platform defines a channel and a platform leading edge, the channel has a minimum radial height line, and the platform leading edge partly defines an outlet through which a secondary flow passes. The ridge line is aligned generally in the direction of the working gas flow and the minimum radial height line is aligned generally in the direction of the secondary flow.

The leading edge foot and the channel may have gas washed surfaces that are smoothly blended to one another.

The leading edge foot and the channel may extend axially forward of the leading edge to define part of the secondary flow outlet.

The leading edge foot may extend axially forward of the leading edge region to the platform leading edge. The leading edge foot may extend axially forward of the leading edge region to within 10% chord length of aerofoil to the platform leading edge.

The leading edge foot may meet the leading edge region at a radial height above the datum in the range 5% to 25% of the radial span.

The radially lowest line may be at a radial height below the datum in the range 2.5% and 20% of the radial span. The radially lowest line may be at a radial height below the datum in the range 2.5% and 20% of the radial span at the maximum depth of the channel.

The deepest or radially innermost point of the radially lowest line may be approximately at the axial position to the leading edge region.

The deepest or radially innermost point of the line may be between the leading edge region and the crown on the suction side. The deepest or radially innermost point of the line may be at the leading edge region. The deepest or radially innermost point of the line may be at the crown on the suction side.

The aerofoil has a leading edge and the leading edge region may be defined up to and including 5% of the chord length of the aerofoil from the leading edge. The leading edge region may be defined up to and including 10% of the chord length of the aerofoil from the leading edge.

The leading edge may be any one of a geometric leading edge or an aerodynamic leading edge. The ridge line may meet the geometric or aerodynamic leading edge of the aerofoil.

The ridge line may be linear or curvilinear or may be a combination of linear and curved or other arcuate form. The form may be relative to any one or more of the circumferential, radial or axial axes. The ridge line may be angled with respect to the axis. The angle with respect to the axis may be when viewed looking radially inwardly. The angle may have a circumferential component. The ridge line may be angled in the range 0 degrees and 45 degrees. The angle may be clockwise or anticlockwise when viewed along the axis of the rotor or engine.

The radially lowest channel path line may be initially angled within 30 degrees of the axis. The radially lowest channel path line may have an upstream part or entry part which is angled within 30 degrees of the axis when viewed radially inwardly. The radially lowest channel path line may be initially angled within approximately parallel to the axis. The angle with respect to the axis may be when viewed looking radially inwardly.

The channel may extend to within and including 10% of an axial extent of the aerofoil from and including a throat area plane. The channel may extend axially forward of or axially rearward of the throat area plane. The channel may extend axially to a trailing edge of the platform. The channel may extend axially to a trailing edge of the aerofoil. The channel may extend axially to between the trailing edge of the platform and the trailing edge of the aerofoil.

The circumferential location of the radially lowest line may be between and including 20% to 60% of an aerofoil pitch from the suction side. The circumferential location of the radially lowest line may be between and including 20% to 60% of an aerofoil pitch from the suction side at channel entry.

At least a portion of the radially lowest line may be located between and includes 5%-35% of the pitch from the suction side at or near the throat plane. At least a portion of the radially lowest line may be located between and includes 5%-35% of the throat pitch.

The leading edge foot may blend out a distance between and including 50% and 100% of an aerofoil chord length from the leading edge region on the pressure side.

The leading edge foot may blend out between and including a suction side crown and the throat plane on the suction side. The suction side crown is a circumferentially forward most point on the aerofoil. The throat plane on the suction side is the position where the throat plane intersects the surface of the suction side wall.

At the leading edge of the platform the ridge line may be aligned generally in the direction of the working gas flow. At the leading edge of the platform the minimum radial height line may be aligned generally in the direction of the secondary flow. At the leading edge of the platform the ridge line may be aligned generally in the direction of the working gas flow and the minimum radial height line may be aligned generally in the direction of the secondary flow.

The blade or vane arrangement is one of an annular array of blades or vane. A rotor assembly may include a disc supporting an annular array of blades. A stator assembly may include a radially inner or outer casing supporting an annular array of stator vanes. A compressor or a turbine may include any one or both the blade or vane arrangement.

The blade or vane arrangement may be of a gas turbine engine for aerospace, marine or industrial application.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings, wherein;

FIG. 4 shows a downstream end of a vane platform of one of an array of stator vanes.

DETAILED DESCRIPTION OF INVENTION

Figure 1:
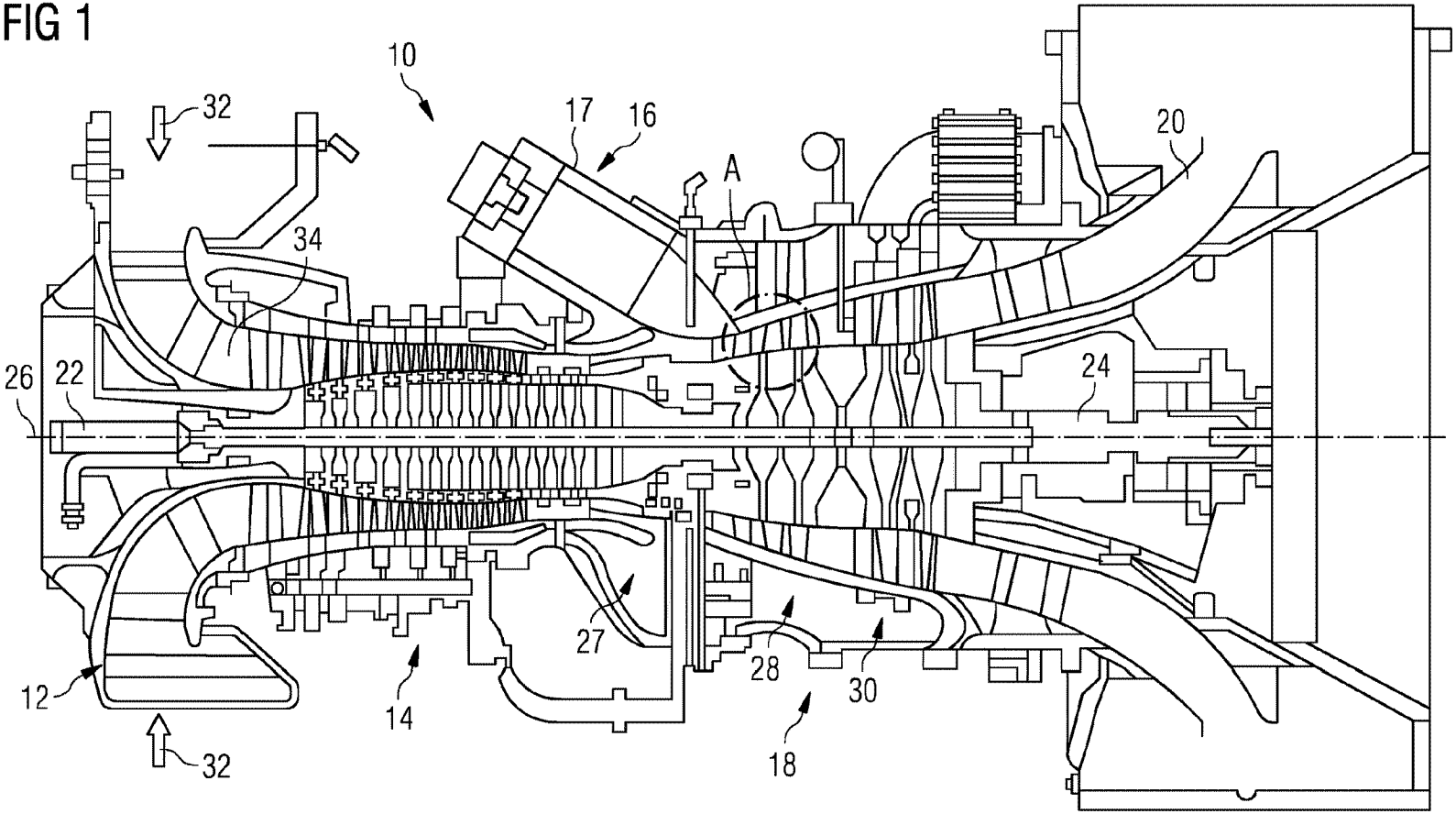
FIG. 1 shows part of a turbine engine in a sectional view and in which the present invention is incorporated, FIG. 2. shows an enlarged view of region A in FIG. 1 and is part of a known compressor-turbine.

FIG. 1 is a schematic illustration of a general arrangement of a turbine engine 10 having an inlet 12, a compressor 14, a combustor system 16, a turbine system 18, an exhaust duct 20 and a twin-shaft arrangement 22, 24. The turbine engine 10 is generally arranged about an axis 26 which for rotating components is their rotational axis. The arrangements 22, 24 may have the same or opposite directions of rotation. The combustion system 16 comprises an annular array of combustor units 17, only one of which is shown. The turbine system 18 includes a high-pressure turbine 28 or compressor-turbine which is drivingly connected to the compressor 14 by a first shaft 22 of the twin-shaft arrangement. The turbine system 18 also includes a low-pressure turbine 30 drivingly connected to a load (not shown) via a second shaft 24 of the twin-shaft arrangement.

The terms radial, circumferential and axial are with respect to the axis 26. The terms upstream and downstream are with respect to the general direction of gas flow through the engine and as seen in FIG. 1 is generally from left to right.

The compressor 14 comprises an axial series of stator vanes and rotor blades mounted in a conventional manner. The stator or compressor vanes may be fixed or have variable geometry to improve the airflow onto the downstream rotor or compressor blades. Each turbine 28, 30 comprises an axial series of stator vanes and rotor blades mounted via discs arranged and operating in a conventional manner.

In operation air 32 is drawn into the engine 10 through the inlet 12 and into the compressor 14 where the successive stages of vanes and blades compress the air before delivering the compressed air into the combustion system 16. In the combustor of the combustion system 16 the mixture of compressed air and fuel is ignited. The resultant hot working gas flow is directed into and drives the high-pressure turbine 28 which in turn drives the compressor 14 via the first shaft 22. After passing through the high-pressure turbine 28, the hot working gas flow is directed into the low-pressure turbine 30 which drives the load via the second shaft 24.

The low-pressure turbine 30 can also be referred to as a power turbine and the second shaft 24 can also be referred to as a power shaft. The load is typically electrical machine for generating electricity or a mechanical machine such as a pump or a process compressor. Other known loads may be driven via the low-pressure turbine. The fuel may be in gaseous or liquid form.

The turbine engine 10 shown and described with reference to FIG. 1 is just one example of a number of turbine engines in which this invention can be incorporated. Such engines include single, double and triple shaft engines applied in marine, industrial and aerospace sectors. This invention may also be applied to steam turbines. Indeed the configuration of the present shaft arrangement can have utility for shafts found in other situation such as ship propeller shafts and land transport shafts.

Figure 2:
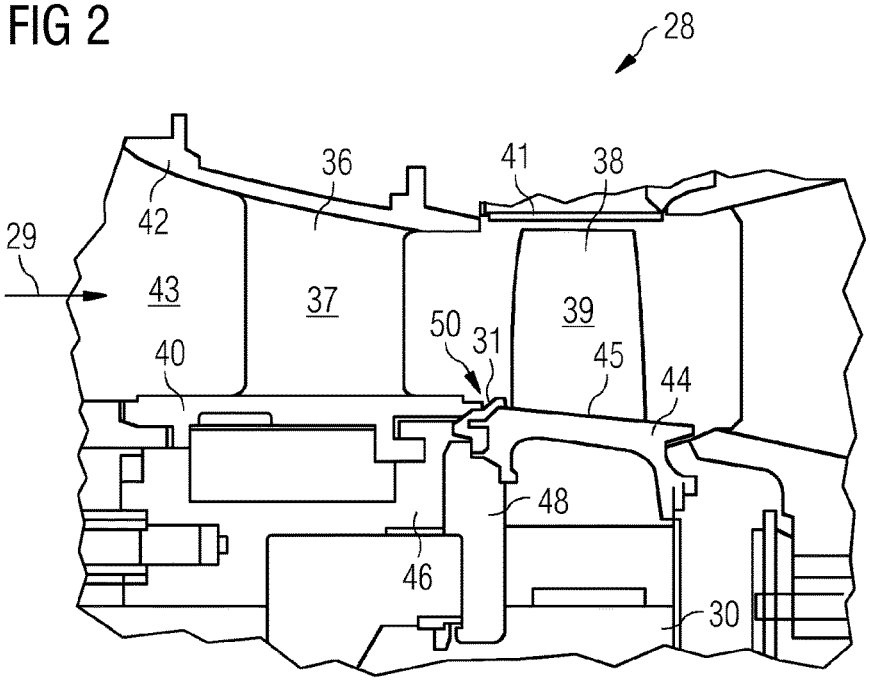

FIG. 2 is an enlarged view of region A in FIG. 1 and is part of a known compressor-turbine 28. The compressor-turbine 28 comprises, in working-gas flow series shown by arrow 29, an annular array of stator vanes 36 and an annular array of rotor blades 38. Further annular arrays of stator vanes and rotor blades are located downstream.

The annular array of stator vanes 36 is provided to impart a swirl or circumferential vector to the working gas flow from the combustor to favourably direct the working gas onto the rotor blades 38 to drive the rotor disc 30 and in turn the compressor 14 via the shaft 22.

Each vane 36 of the annular array of stator vanes 36 includes an aerofoil 37 mounted between a radially inner vane platform 40 and a radially outer vane platform 42. The annular array of stator vanes 36 are secured in a conventional manner referred to here as vane mountings 46. Each rotor blade 38 of its annular array includes an aerofoil 39 mounted on a blade platform 44 and rotating within a casing 41 that surrounds the rotor assembly.

The aerofoils 37, 39 of both the vanes and blades comprise a pressure side wall and a suction side wall that meet and define a leading edge and a trailing edge as is convention. In general, the pressure side wall is concave and the suction side wall is convex. One pressure side wall of one aerofoil faces a circumferentially adjacent suction side wall of another aerofoil and together an aerofoil passage is formed; there being a corresponding number of aerofoil passages around the circumference of the blade or vane array.

This annular array of conventional rotor blade platforms 44 form a conical and axisymmetric gas-wash surface 45. A conventional small fillet is provided between the platform 44 and the aerofoil 39 to give a smooth transition of their surfaces to reduce stresses.

The platforms and casing form a working gas passage 43 through the turbine 28 and are gas-washed surfaces. A seal 50 is defined by the annular array of vanes 36/vane mounting 46 and the rotor assembly 38, 30.

Radially inwardly of the vane platform 40 and blade platform 44 and generally axially between the vane mountings 46 and the blade/disc assembly 38, 30 is a disc wheel space 48. Cooling air is used in a conventional manner to cool the vane array 36, the rotor blades 38 and the disc 30. Some of the cooling air enters the disc wheel space 48. Additional cooling air is also applied at the wheel-space 48 to prevent hot gas ingestion from entering the wheel-space. This cooling air with the ingested hot fluid discharges as shown by arrow 31 through the seal 50 and enters the working gas passage 43. The seal 50 and the egressing cooling flow is desirable because a positive pressure of the coolant in the disc wheel space 48 normally prevents hot working gases 29 entering the seal 50 and into the disc wheel space 48.

During operation, this conventional configuration incurs a strong cross-flow of working gases across the aerofoil passage in the end wall platform region. This is caused by a high pressure gradient from the pressure side wall to the suction side wall. Furthermore, the gas flow stagnates in front of the leading edge region of the aerofoil at the junction between leading edge and platform causes strong horse-shoe vortices to form. Both the cross-flow and the horse-shoe vortices lead to significant secondary flow or aerodynamic losses.

Thus one problem of the conventional arrangement described above is the aerodynamic interaction of the working gas flow 29 with the discharging sealing flow 31 of coolant from disc wheel-space 48. This interaction leads to aerodynamic losses, increased temperatures of the surfaces in the gas passage and in some operational conditions of the engine ingestion of the hot working gases into the side wheel space 48.

Figure 3:
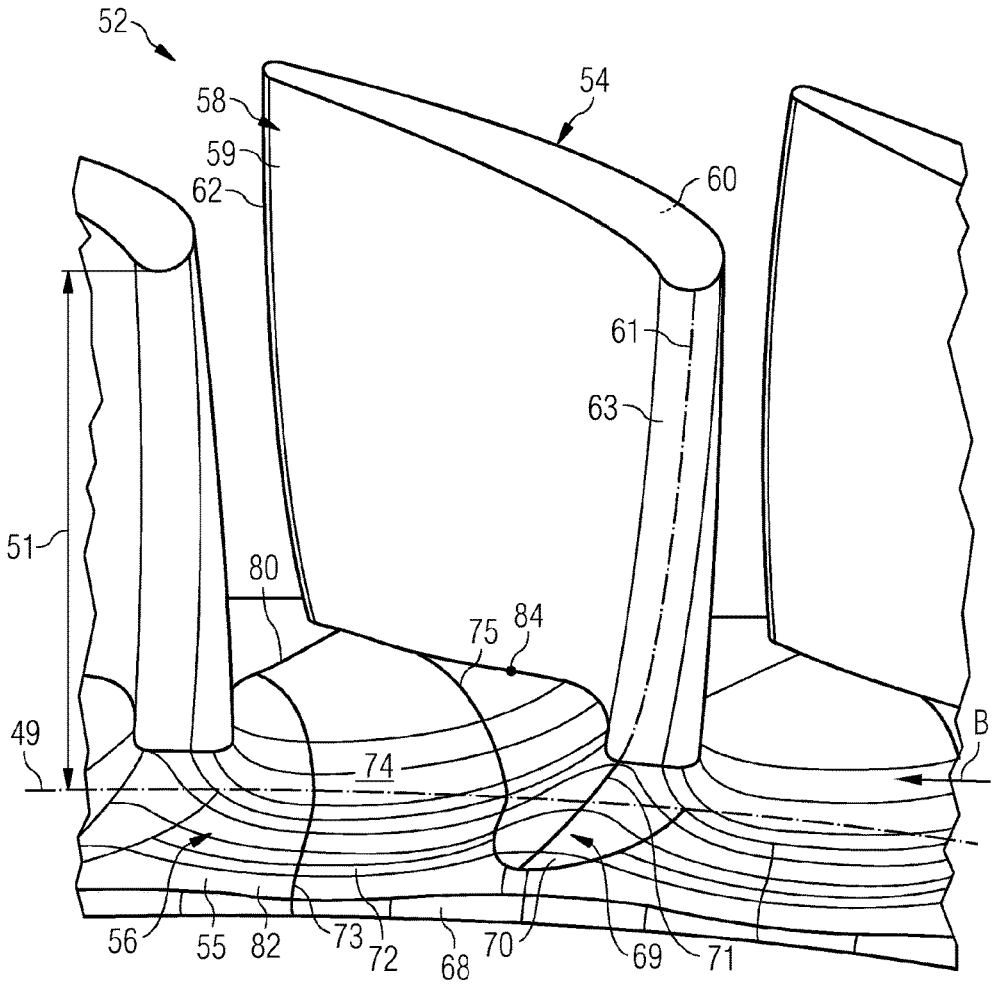
FIG. 3 is a view looking rearwardly at a number of blades of an array of blades of a compressor-turbine and in particular shows a contoured surface of a platform including a channel and leading edge foot of an aerofoil extending from its leading edge in accordance with the present invention.
Figure 4:
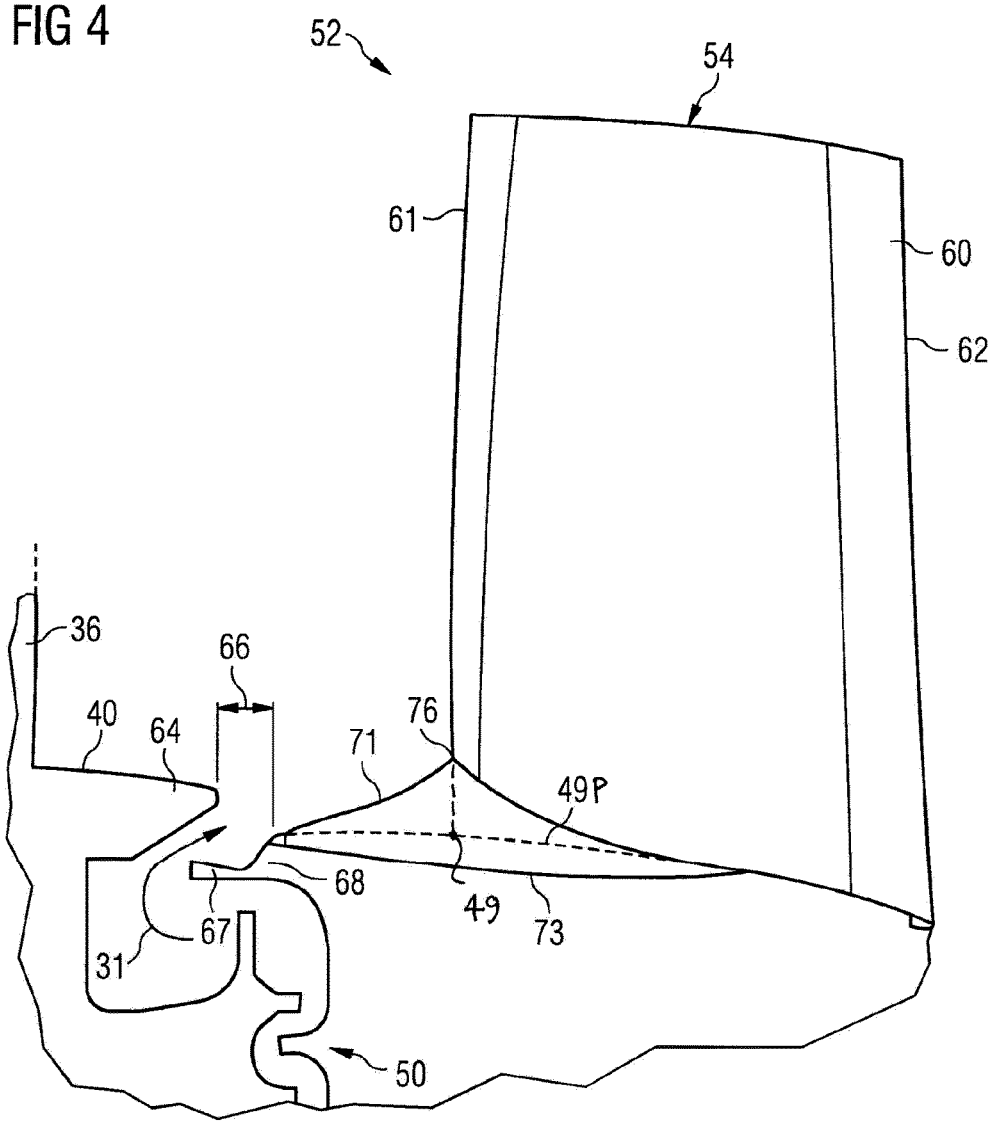
FIG. 4 is a view looking circumferentially, along arrow B shown in FIG. 3, at the blade 54. In addition

Referring now to FIGS. 3 and 4 which depict an exemplary embodiment of the present invention. FIG. 3 is a view looking rearwardly at a number of blades 54 of an array of blades 52 the compressor-turbine 28 and in particular shows a contoured surface 55 of a platform 56 in accordance with the present invention. FIG. 4 is a view looking circumferentially, along arrow B shown in FIG. 3, at the blade 54. In addition to FIG. 3, FIG. 4 shows a downstream end 64 of the vane platform 40 of one of the array of stator vanes 36 shown and described above.

The blade 54 comprises an aerofoil 58 having a pressure side wall 59 and a suction side wall 60 that meet and define a leading edge 61 and a trailing edge 62. The aerofoil 58 is mounted to the blade platform 56, which is turn is mounted on a fixture that secures the blade to the rotor disc. This fixture is of a conventional configuration.

The present invention relates to an aerofoil that comprises a leading edge foot 69 defining a first surface 70 and a platform 56 that is contoured and comprises a channel having a second surface 72. This arrangement could also be described as the having a forwardly extended platform; and the platform as defining the first and second surfaces 70, 72.

A datum 49 is indicated by a circular line 49 in FIG. 3 which is centred on the rotational axis 26 of the rotor and circumscribes each nominal junction between a leading edge 61 of the aerofoil 58 and the platform 56 around the rotational axis 26. A datum surface or plane is also indicated in FIG. 4 by line 49P which can also represent part of the profile of the gas wash surface of a conventional platform. The datum surface or plane 49P is formed by rotation of the line 49P about the rotational axis 26. Here the datum surface is generally frusto-conical or it can be cylindrical in other cases. The datum surface 49P and datum line 49 can be an averaged plane or line of the radial heights of the first and second surfaces 70, 72 in accordance with the present invention. In one example of the present invention the cross-sectional area of the flow passage between aerofoils and radially facing endwalls (platform and casing) is the same as a conventional equivalent configuration. In other examples, the cross-sectional area of the flow passage can be greater or smaller than a conventional equivalent configuration. The following description of the present invention refers to the datum line 49 and datum plane 49P.

The first surface 70 is raised in radius compared to a conventional axisymmetric and circular rotor platform or raised relative to the datum line 49 or plane 49P. The second surface 72 is lower in radius compared to a conventional axisymmetric and circular rotor platform or radially lower relative to the datum line 49 or plane 49P.

A platform leading edge 68 of the platform 56 extends axially forward of the aerofoil leading edge 61. The leading edge foot 69 starts at or close to the platform leading edge 68. An axial or seal gap 66 is formed between the downstream end 64 of the vane platform 40 and the platform leading edge 68. A seal nose 67 extends forwardly of the leading edge 68 to form an effective seal with corresponding seal features of the vane mountings 46 to form the seal 50.

The first surface 70 has a maximum radial height relative to the datum line 49 and shown by a ridge line 71. The second surface 72 has a minimum radial height relative to the datum line 49 and shown by the channel line 73. The line 75 is a line of inflection between the two surfaces 70, 72. In this embodiment, the first surface 70 is convex at the leading edge 68 of the platform and extends rearwardly and circumferentially next to the leading edge foot 69 region. The convex shape blends out downstream of the leading edge 61 of the aerofoil. In this exemplary embodiment the convex shape blends out immediately downstream of the leading edge foot 69. In other embodiments the convex shape can blend out at about the throat plane 80. The second surface 72 is concave. The first surface 70 and the second surface 72 are blended to provide a smooth gas wash surface.

The aerofoil 54 has a radial span 51 defined here as from the datum 49 to the tip of or radially outermost part of the aerofoil. The aerofoil has a chord length which is defined along a line on the pressure side or suction side from the leading edge to the trailing edge. The aerofoils 54 are circumferentially spaced apart and such spacing is referred to as the pitch.

Figure 5:
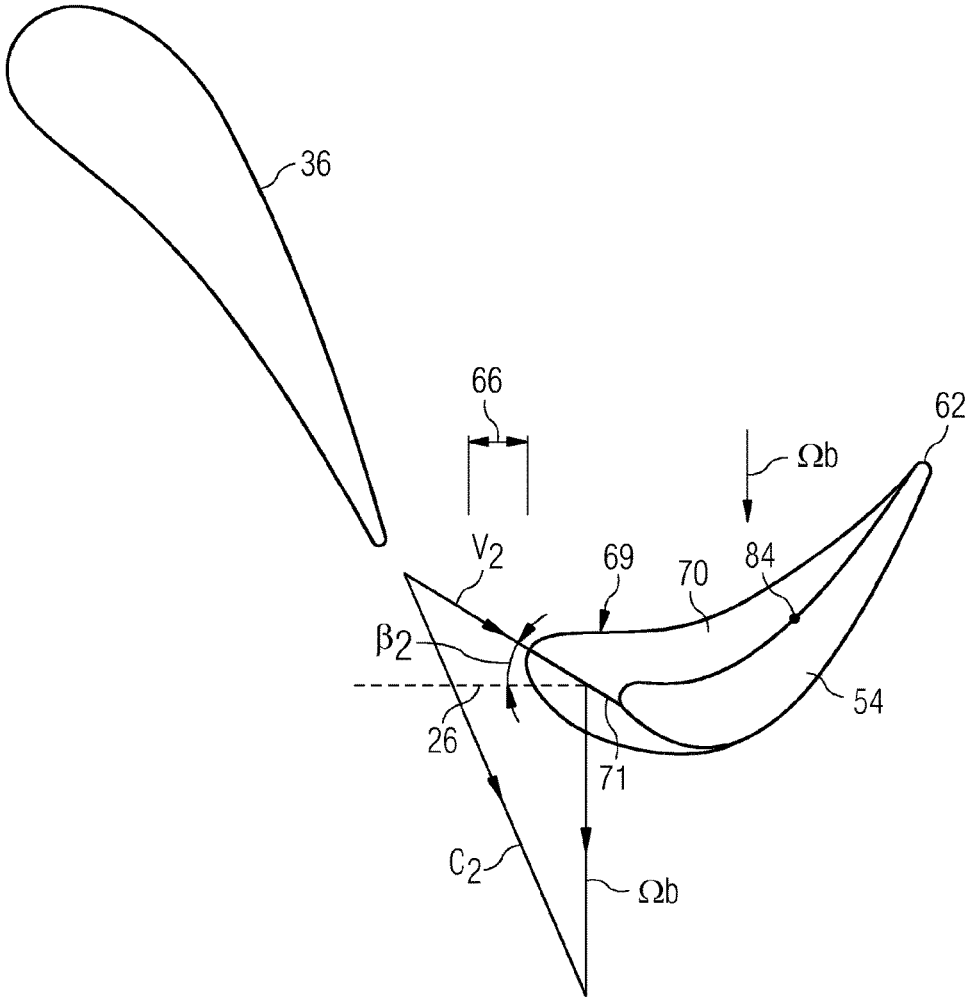
FIG. 5 is a schematic plan view, looking radially inwardly, of one nozzle guide vane and one rotor blade and relative rotational speed along with velocity vectors of the working gas flow at a particular design point.

FIG. 5 is a schematic plan view of one nozzle guide vane 36 and one rotor blade 54 along with velocity vectors of the working gas flow at a particular design point. Working gas flow impinges on the nozzle guide vane 36 and is forced to follow the curvature of the vane such that as the gas flow exits the vane's trailing edge it has a velocity vector C2 comprising circumferential and axial velocity components. The rotor blade 54 is rotated by the impinging working gases in the direction of velocity arrow Ωb in a circumferential direction. Thus the relative velocity of the gas flow onto the leading edge 61 of the rotor blade 54 is along the line V2.

In this exemplary embodiment, the leading edge foot 69 extends to the seal gap 66. At the seal gap 66, the radial height is about the same as the conventional platform or datum surface 49. The leading edge foot 69 has a smooth transition where it blends into the leading edge 68 that forms part of the seal gap 66. The radial height of the junction where the ridge line 71 meets the leading edge 68 is approximately the same as the conventional platform leading edge design. At the intersection with the leading edge of the platform, the ridge line 71 is aligned with the relative velocity vector V2 and meets the geometric leading edge 61 of the blade at a radial location or height which is 12.5% of the radial span 51 and relative to the datum 49. This radial height can be between and include 5% to 25% of the radial span 51 relative to the datum 49 to gain at least some of the benefits of the present invention, but in particular this radial height is between 10%-15% radial span 51 for most applications.

The geometric leading edge 61 is the axially forward part of the aerofoil 54 and in this example is the geometric leading edge or forward most line along the radial extent of the aerofoil 54. It is also possible for the leading edge 61 to be defined as the aerodynamic leading edge, which is defined as the point at which gas flow separates between pressure side and suction side flows. The position of the aerodynamic leading edge can vary dependent on the operating condition of the engine. The geometric and aerodynamic leading edges are within a leading edge region 63 which extends from the geometric leading edge 61 rearwardly a distance of 5% of the aerofoil's chord length at a particular radial position.

The leading edge foot 69 has its ridge line 71 meeting, at position 76 (in FIG. 4), the aerodynamic leading edge 61 of the aerofoil 54 at a radial height of 12.5% of the radial span 51 of the aerofoil. The applicant believes the present invention is advantageous where the radial height of the foot at the intersection of the ridge 71 and leading edge 61 is between and includes 5% to 25% of the radial span 51. It is believed that the most effective range of radial heights of the foot at the intersection is between and includes 10% and 15% of the aerofoil's radial span 51.

On the pressure side 59 of the aerofoil, the leading edge foot 69 blends out towards the trailing edge 62 of the rotor blade 54 and smoothly transitions with the surface of the channel 74 on the platform. The blend out or the axial extent of the leading edge foot 69 on the pressure side 59 is between a mid-chord position 84 and the trailing edge 62. This blend out achieves a smooth transition to the airfoil pressure side 59 and the platform channel 74. In this exemplary embodiment of FIG. 3, the blend out occurs at a position 75% of the aerofoil chord length from the leading edge 61. The blend-out or axial extent of the leading edge foot 69 may be between and including 50% and 100% of the chord length from the leading edge 61.

Figure 6A:
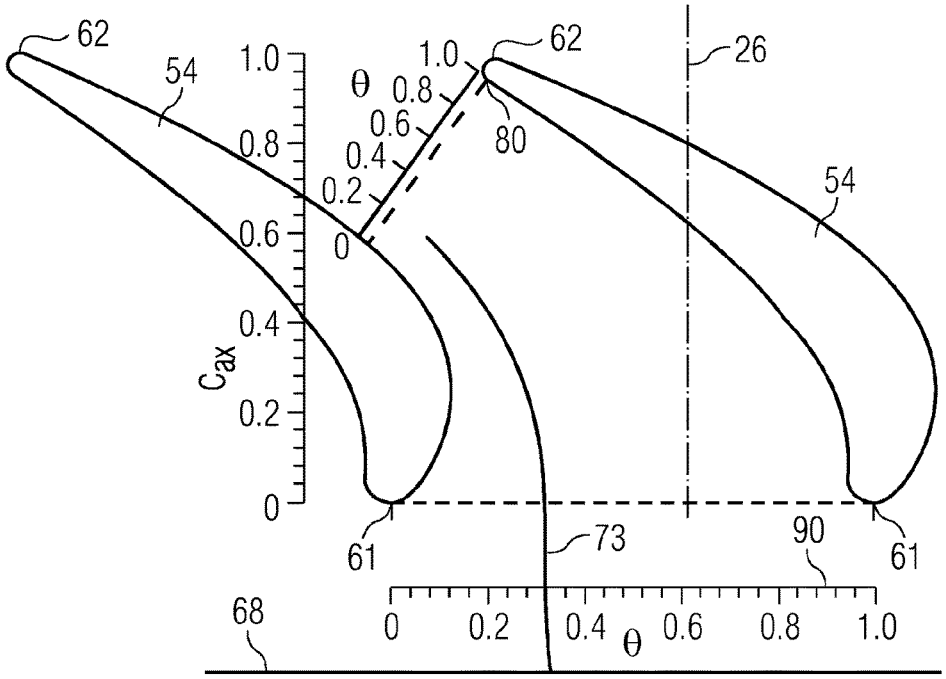
FIG. 6A is a schematic plan view, looking radially inwardly, of two aerofoils showing relative scales of an aerofoil pitch, a throat plane and an axial aerofoil chord $C_{ax}$.
Figure 6B:
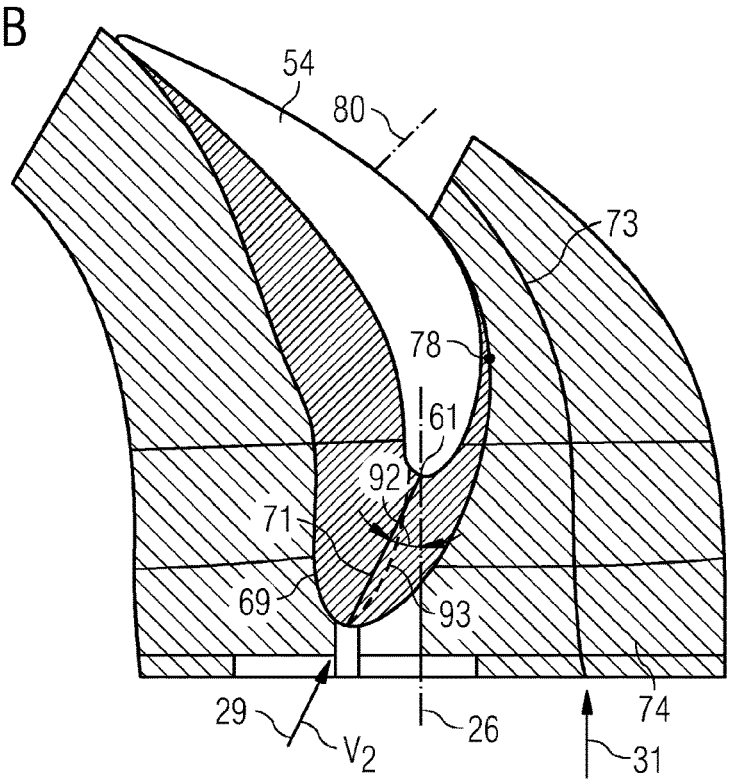
FIG. 6B is a schematic plan view, looking radially inwardly, of one aerofoil and platform and showing angles of the channel and leading edge foot.

On the suction side 60 of the aerofoil, the leading edge foot 69 merges with the platform channel 74, described in more detail below, to form a smooth transition. The blend out on the suction side 60 can take place between the suction side crown 78 and the throat plane 80 as shown in FIGS. 6A and 6B. In this example the blend out or axial extent of the leading edge foot 69 occurs at approximately 50% of the suction surface chord length from the leading edge 61. In other examples the leading edge foot 69 may blend out between and including the suction side crown 78 and the throat plane 80.

FIG. 6A is a plan view, looking radially inwardly, of two circumferentially adjacent aerofoils 54. Scales of an aerofoil pitch 90, a throat plane 80 and an axial extent $C_{ax}$ are shown. The scales can be interpreted as percentages of these geometric parameters. The aerofoil pitch 90 is the circumferential distance from one aerofoil to another and as shown from the leading edge 61 of one aerofoil to the leading edge 61 of the adjacent. The throat plane 80 is the location of the minimum area of the gas passage defined by the aerofoils and any end wall, platform or casing depending on application to a blade or vane. In this example, the throat plane 80 is located from the suction side of one aerofoil (0%) to the pressure side of the adjacent blade near to the trailing edge (100%) and immediately before the rounded trailing edge profile begins. The axial extent $C_{ax}$ is measured from the leading edge 61 of the aerofoil (0%) and in an axially rearward direction, parallel to the engine axis 26, with 100% at the trailing edge 62.

FIG. 6B is a plan view, looking radially inwardly, of one aerofoil 54 and platform showing angles of the channel 74 and leading edge foot 69 relative to the axis 26. The ridge line 71 of the leading edge foot 69 is aligned with the oncoming main working gas flow 29 having relative velocity vector V2. In this example the ridge line 71 is generally linear and parallel to the relative velocity vector V2. However, in other examples the ridge line 71 may be angled relative to the oncoming main working gas flow 29 and at different working condition the relative velocity vector V2 may be different due to the different speeds Ωb of the rotor for example. The angle 92 of the ridge line 71 may be angled in the range 0 degrees to 45 degrees relative to the engine axis 26. In the case of a vane the angle 92 of the ridge line 71 may be angled in the range −45 degrees to 0 degrees relative to the engine axis 26.

Furthermore, the ridge line 71 may be curvilinear as shown by the line 93. The upstream part of the curvilinear ridge line 93 can be angled to be aligned with the oncoming main working gas flow direction and assist in turning the flow onto the pressure side surface of the aerofoil.

The channel 74 is formed by the platform surface or second surface 72.

Rather than a cylindrical or conical platform surface of a conventional design as indicated by the datum line 49, the platform surface 72 is radially lowered towards a radially lowest line or minimum radial height line 73 as shown in FIG. 3, FIG. 4 and FIGS. 6A and 6B. A channel entry 82 is formed at the platform leading edge and which is in the rim-seal outlet region 50. The channel entry 82 extends to and partly forms the axial or seal gap 66.

The minimum radial height line 73 is initially aligned with the direction of the egress seal leakage flow 31 from the seal gap 66 and extends up to a throat plane or area 80. The minimum radial height line 73 is initially angled within 30 degrees of the axis 26 in a plan view looking radially inwardly. As the seal leakage flow 31 travels along or over the platform surface 55 it tends to follow the curvature of the blade aerofoil through the gas passage.

The throat plane 80 is defined by a minimum distance between the trailing edge 62 of one aerofoil to the suction surface of a neighbouring aerofoil. The channel 74 may curtail axially forward or axially rearward of the throat plane 80. However, in either case the resultant throat area may be affected and thus this should be considered in the design of the blade or vane array. In this exemplary embodiment, the channel 74 extends to the throat plane 80, but can extend to within 10% of an axial extent, $C_{ax}$, of the aerofoil from a throat area plane 80.

The maximum channel depth or its radially lowest line 73 is approximately 10% of the blade's radial span 51 radially lower than datum line 49 or the conventional axisymmetric platform. It is believed that a maximum depth or radial lowering from nominal can be up to 20% of the radial span 51 of the aerofoil and a minimum of 2.5% to have a beneficial effect. One optimal range is between and including 5%-10% of the radial span 51 of the aerofoil. The deepest point of the line 73 relative to the datum platform 49 or the maximum depth of channel 74 is where $C_{ax}$=0, i.e. at the leading edge 61 axial location of the blade or shortly downstream of this point up to the suction surface crown 78 axial position. This arrangement is advantageous in having the radially lowest part or the maximum depth of the channel 74 in the axial range between the leading edge 61 and the suction surface crown 78 because the flow field decelerates and hence increases the static pressure on the suction side to create a more favourable pressure gradient to reduce the cross passage secondary flow.

At the channel entry 82, at the platform leading edge 68, the relative radial height of the channel 73/74 depends on the type of seal arrangement 67. For the example described here, this is a particular configuration; however, the radial height of the channel can vary where other configurations of the rim seal 67 is used. The channel 73/74 is blended out near the throat plane 80. In other examples, the channel 73/74 may extend further downstream and beyond the throat plane 80 and towards the aerofoil trailing edge 62 or even the trailing edge of the platform 44.

The radially lowest line 73 of the channel 74 starts circumferentially between the elongated leading edge foot 69 on the platform with a position biased towards the suction side 60. The exact location for any given geometry is determined by the peak egress flow position at the rim-seal outlet 50 and channel entry 82 and is relative to the rotor blade leading edge 61 in a circumferentially sense. Advantageously, the location of the radially lowest line 73 is normally between 20%-60% of blade pitch as shown in FIGS. 6A and 6B from the suction side 60. Within blade passage the radially lowest line 73 is a distance approximately 20% of the blade throat pitch range at the throat plane 80. In other examples, the radially lowest line 73 is within range of a distances equivalent to 5%-35% of the blade throat pitch range at the throat plane 80.

The channel orientation at the blade platform upstream entry region 82 is mainly determined by the average egress flow direction and the projection of this on to the blade platform is normally approximately parallel to the machine axial direction 26 and may be within ±30° of the axis 26. Moving axially rearwards as the deepest channel path line 73 approaches the suction side of the aerofoil it follows the streamwise direction until it merges with the conventional axisymmetric platform before or at the throat plane 80.

The aerofoil and platform configuration is equally applicable to a blade array or a vane array. For a vane array the aerofoil and platform configuration may be applied to either or both the radially inner or radially outer gas passage surfaces.

The aerofoil and platform configuration is advantageous because the main working gas flow and the seal leakage flow incur less viscous mixing in the passage owing to a reduced secondary flow and better control of discharging sealing flow; hence there is an increase in stage efficiency. In addition, a decrease in surface gas temperature of the platform has been identified. Further, the seal leakage flow remains attached to the platform surface 55 further downstream thereby increasing cooling coverage. It is also found that there is a reduced likelihood of ingestion to the disc wheel space of hot working fluid by virtue of a more favourable external driving pressure due to the reduced leading edge loading of the blades and secondary flows.

Figure 7A:
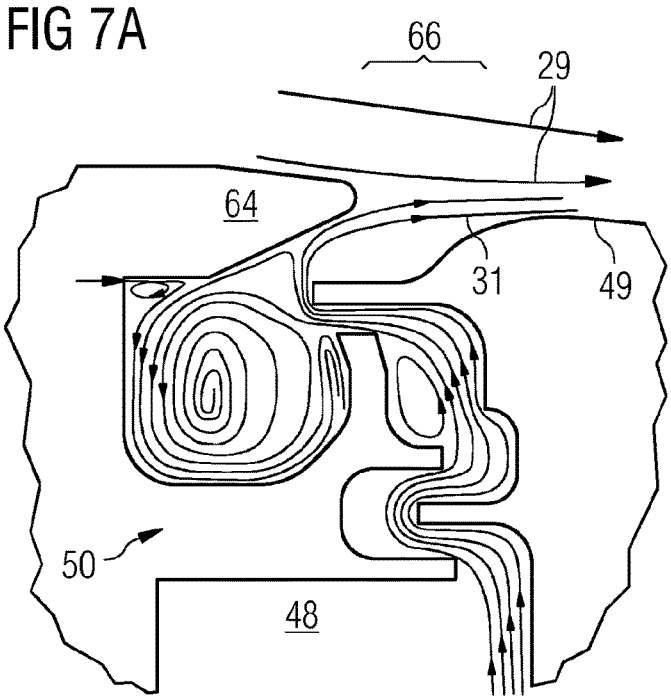
FIGS. 7A and 7B are circumferential views of a seal and outlet region of a conventional design and the present invention respectively and show a seal leakage flow egressing the outlet.
Figure 7B:
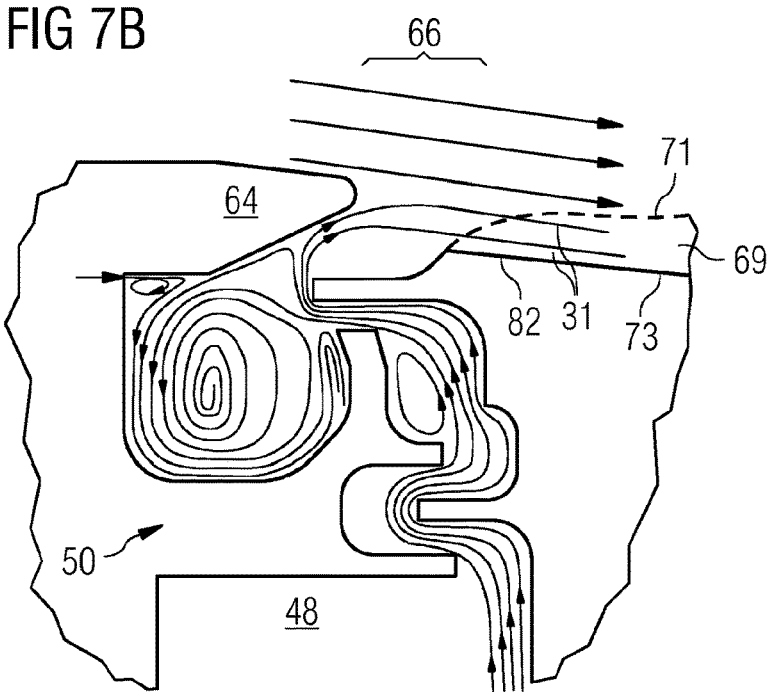

Referring to FIGS. 7A and 7B, these circumferential views of the seal 50 and outlet regions of a conventional design and the present invention respectively show the seal leakage flow 31 egressing the outlet 66. In FIG. 7A, the egressing leakage flow is forced radially outwardly and over the conventional platform shown by datum line 49. In this case the egressing flow 31 mixes with the main working gas flow 29 around and immediately downstream of the outlet 66 causing turbulence and the hot working gas to impinge on the platform 45 and aerofoil surfaces. For the present invention as shown in FIG. 7B, the egressing leakage flow 31 is forced into the channel 74 and along with the effect of the leading edge foot 69 on the main working gas flow, separates the two gas flows preventing or significantly reducing mixing.

The reduced entry point of the main working gas flow 29 or streamline next to the channel at the platform entry region and into the platform channel indicates a reduced angle of the leakage flow 31 relative to the mainstream flow as it is pushed into this channel by the mainstream flow. This means that the egressing coolant flow 31 remains attached to the platform surface in the channel and it mixes less with the mainstream flow. This reduces aerodynamic losses associated with the two flows when they mix. When the egressing coolant or leakage flow 31 enters the passage between aerofoils its temperature is lower than the conventional design which has a benefit for improved platform cooling.

Figure 8A:
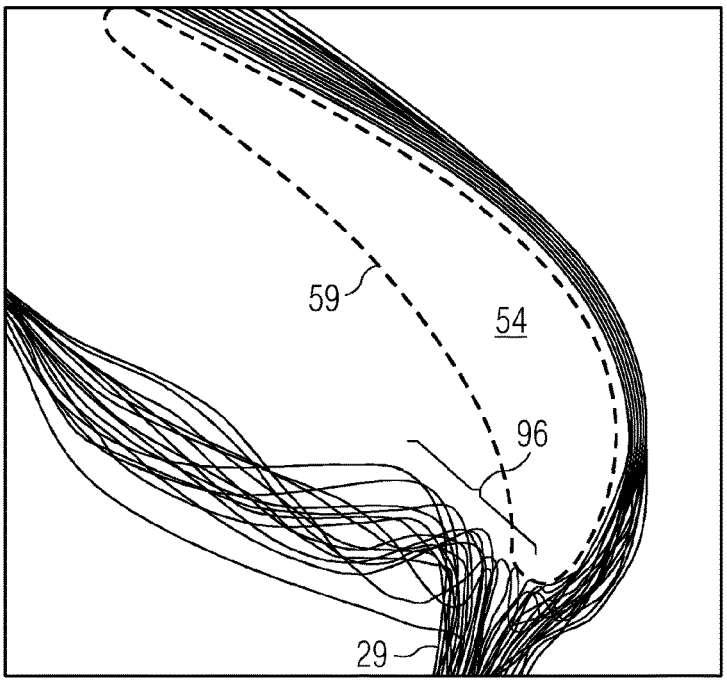
FIGS. 8A and 8B are plan views of an aerofoil showing streamlines of the main working gas flow for a convention design and the present invention respectively.
Figure 8B:
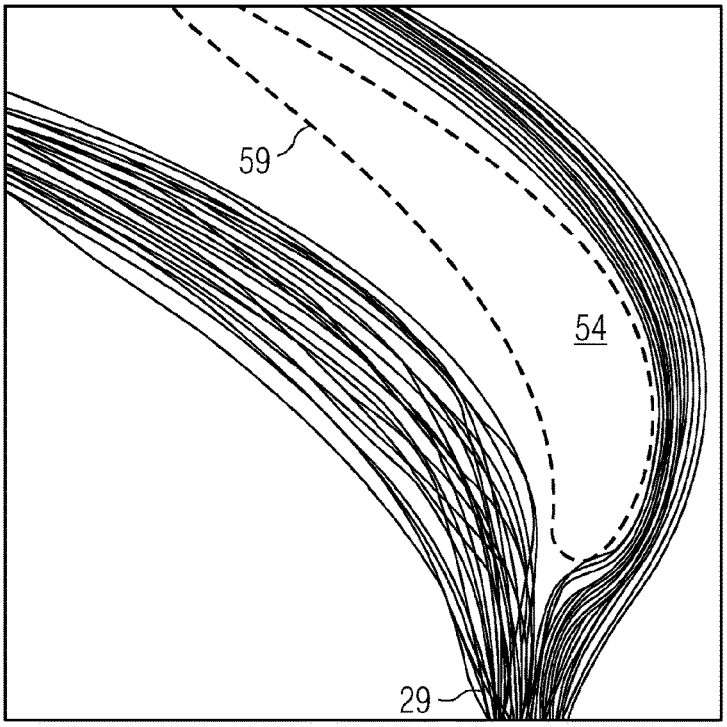

A further advantage of the present invention can be seen in FIGS. 8A and 8B which show velocity streamlines of the main working gas flow 29 for the convention design and present invention respectively. These velocity streamlines are initiated in the endwall region or near to the surface of the platform. In FIG. 8A, the conventional design causes horseshoe vortices 96 which are aerodynamically inefficient. For the present invention shown in FIG. 8B, the horseshoe vortices are significantly reduced and can be eliminated completely. As can be seen the main working gas flow 29 the streamlines are significantly more linear and smoother. Thus this creates a more aerodynamically efficient condition improving overall engine efficiency. Furthermore, the cross passage secondary or leakage flow 31 from the pressure side 59 to the suction side 60 has also been significantly reduced by virtue of the leading edge foot 69 and channel 74.

The leading edge foot 69 and channel 74 features of the present invention leads to a reduction in blade front aerodynamic loading and hence a more favourable pressure gradient that reduces the cross passage flow of the main working gas. This further helps to reduce the secondary flow 31 and hence less secondary flow losses. The further reduction in cross-passage secondary flow also helps the egress coolant to stay on the platform surface much further downstream rather than being swept across the passage relatively early in the conventional design. This gives an improved benefit to blade platform cooling.

Figure 9A:
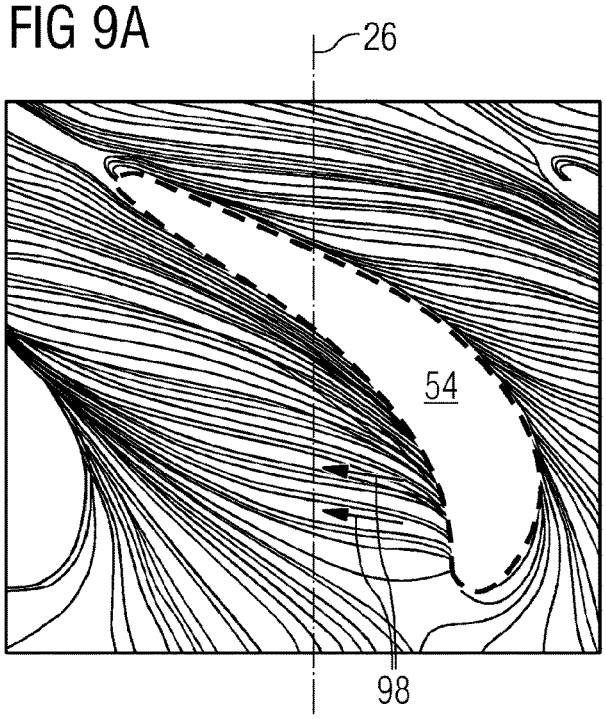
FIGS. 9A and 9B are plan views of an aerofoil showing streamlines of a seal leakage gas flow for a convention design and the present invention respectively.
Figure 9B:
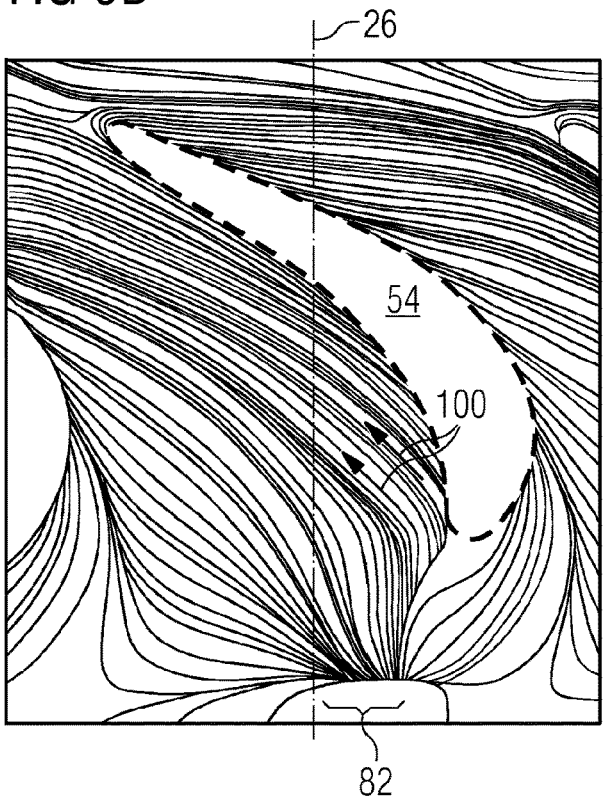

FIGS. 9A and 9B are plan views of an aerofoil showing streamlines of a seal leakage gas flow for a convention design and the present invention respectively. For the convention design in FIG. 9A, there is a strong cross passage flow shown by arrows 98. In other words, the streamline arrows 98 have a significant circumferential velocity vector. However, in FIG. 9B, in the same location the velocity vector arrows 100 have a lesser velocity vector in the circumferential direction. For the present invention, the streamlines are more in alignment with gas passage shape. Thus this reduction in cross-flow improves the efficiency of the gas flow and overall efficiency of the gas turbine engine.

While the invention has been illustrated and described in detail for a preferred embodiment the invention is not limited to these disclosed examples and other variations can be deducted by those skilled in the art in practicing the claimed invention.

The invention claimed is:

1. A blade or vane arrangement for a gas turbine engine, comprising:

an array of aerofoils mounted to respective platforms about an axis and defining a passage through which a working gas flow passes, and a datum, wherein each aerofoil of the array of aerofoils comprises a radial span, a pressure side, a suction side, a leading edge region, and a leading edge foot extending from the leading edge region, the leading edge foot comprising a ridge line, wherein each platform defines a channel and a platform leading edge, the channel comprises a minimum radial height line, and the platform leading edge partly defines a secondary flow outlet through which a secondary flow passes, wherein the ridge line is aligned generally in a direction of the working gas flow and the minimum radial height line is aligned generally in the direction of the secondary flow, and wherein the ridge line is linear or curvilinear and is angled with respect to the axis in a range 0 degrees and 45 degrees.

2. The blade or vane arrangement as claimed in claim 1, wherein the leading edge foot and the channel comprise gas washed surfaces that are smoothly blended to one another.

3. The blade or vane arrangement as claimed in claim 1, wherein the leading edge foot and the channel extend axially forward of a leading edge of the aerofoil and define part of the secondary flow outlet.

4. The blade or vane arrangement as claimed in claim 1, wherein the leading edge foot extends axially forward of the leading edge region to the platform leading edge.

5. The blade or vane arrangement as claimed in claim 1, wherein the leading edge foot meets the leading edge region at a radial height above the datum in the range 5% to 25% of the radial span.

6. The blade or vane arrangement as claimed in claim 1, wherein the minimum radial height line is at a radial height below the datum in a range 2.5% and 20% of the radial span at a maximum depth of the channel.

7. The blade or vane arrangement as claimed in claim 1, wherein a deepest or radially innermost point of the minimum radial height line is approximately at an axial position of the leading edge region.

8. The blade or vane arrangement as claimed in claim 1, wherein a deepest or radially innermost point of the minimum radial height line is between the leading edge region and a crown on the suction side.

9. The blade or vane arrangement as claimed in claim 1, wherein the leading edge region is defined up to and including 5% of a chord length of the aerofoil from a leading edge of the aerofoil.

10. The blade or vane arrangement as claimed in claim 1, wherein the a leading edge of the aerofoil is any one of a geometric or aerodynamic leading edge and the ridge line meets the leading edge.

11. The blade or vane arrangement as claimed in claim 1, wherein the minimum radial height line is initially angled within 30 degrees of the axis.

12. The blade or vane arrangement as claimed in claim 1, wherein the channel extends to within 10% of an axial extent of the aerofoil from and including a throat plane.

13. The blade or vane arrangement as claimed in claim 1, wherein a circumferential location of minimum radial height line is between and includes 20% to 60% of an aerofoil pitch from the suction side at a channel entry of the channel.

14. The blade or vane arrangement as claimed in claim 1, wherein at least a portion of the minimum radial height line is located between and includes 5%-35% of an aerofoil pitch from the suction side at or near a throat plane.

15. The blade or vane arrangement as claimed in claim 1, wherein the leading edge foot blends out a distance between and including 50% and 100% of an aerofoil chord length from the leading edge region on the pressure side.

16. The blade or vane arrangement as claimed in claim 1, wherein the leading edge foot blends out between and including a suction side crown and a throat plane on the suction side.

17. The blade or vane arrangement as claimed claim 1, wherein at a leading edge of the platform the ridge line is aligned generally in the direction of the working gas flow and the minimum radial height line is aligned generally in the direction of the secondary flow.

18. A blade or vane arrangement for a gas turbine engine, comprising:

an array of aerofoils mounted to respective platforms about an axis and defining a passage through which a working gas flow passes, and a datum, wherein each aerofoil of the array of aerofoils comprises a radial span, a pressure side, a suction side, a leading edge region, and a leading edge foot extending from the leading edge region, the leading edge foot comprising a ridge line, wherein each platform defines a channel and a platform leading edge, the channel comprises a minimum radial height line, and the platform leading edge partly defines a secondary flow outlet through which a secondary flow passes, wherein the ridge line is aligned generally in a direction of the working gas flow and the minimum radial height line is aligned generally in the direction of the secondary flow, and wherein the minimum radial height line is at a radial height below the datum in the range 2.5% and 20% of the radial span at a maximum depth of the channel.

19. A blade or vane arrangement for a gas turbine engine, comprising:

an array of aerofoils mounted to respective platforms about an axis and defining a passage through which a working gas flow passes, and a datum, wherein each aerofoil of the array of aerofoils comprises a radial span, a pressure side, a suction side, a leading edge region, and a leading edge foot extending from the leading edge region, the leading edge foot comprising a ridge line, wherein each platform defines a channel and a platform leading edge, the channel comprises a minimum radial height line, and the platform leading edge partly defines a secondary flow outlet through which a secondary flow passes, wherein the ridge line is aligned generally in a direction of the working gas flow and the minimum radial height line is aligned generally in the direction of the secondary flow, and wherein a deepest or radially innermost point of the minimum radial height line is between the leading edge region and a crown on the suction side.

20. A blade or vane arrangement for a gas turbine engine, comprising:

an array of aerofoils mounted to respective platforms about an axis and defining a passage through which a working gas flow passes, and a datum, wherein each aerofoil of the array of aerofoils comprises a radial span, a pressure side, a suction side, a leading edge region, and a leading edge foot extending from the leading edge region, the leading edge foot comprising a ridge line, wherein each platform defines a channel and a platform leading edge, the channel comprises a minimum radial height line, and the platform leading edge partly defines a secondary flow outlet through which a secondary flow passes, wherein the ridge line is aligned generally in a direction of the working gas flow and the minimum radial height line is aligned generally in the direction of the secondary flow, and wherein the minimum radial height line is initially angled within 30 degrees of the axis.

21. A blade or vane arrangement for a gas turbine engine, comprising:

an array of aerofoils mounted to respective platforms about an axis and defining a passage through which a working gas flow passes, and a datum, wherein each aerofoil of the array of aerofoils comprises a radial span, a pressure side, a suction side, a leading edge region, and a leading edge foot extending from the leading edge region, the leading edge foot comprising a ridge line, wherein each platform defines a channel and a platform leading edge, the channel comprises a minimum radial height line, and the platform leading edge partly defines a secondary flow outlet through which a secondary flow passes, wherein the ridge line is aligned generally in a direction of the working gas flow and the minimum radial height line is aligned generally in the direction of the secondary flow, and wherein the leading edge foot blends out a distance between and including 50% and 100% of an aerofoil chord length from the leading edge region on the pressure side.

22. A blade or vane arrangement for a gas turbine engine, comprising:

an array of aerofoils mounted to respective platforms about an axis and defining a passage through which a working gas flow passes, and a datum, wherein each aerofoil of the array of aerofoils comprises a radial span, a pressure side, a suction side, a leading edge region, and a leading edge foot extending from the leading edge region, the leading edge foot comprising a ridge line, wherein each platform defines a channel and a platform leading edge, the channel comprises a minimum radial height line, and the platform leading edge partly defines a secondary flow outlet through which a secondary flow passes, wherein the ridge line is aligned generally in a direction of the working gas flow and the minimum radial height line is aligned generally in the direction of the secondary flow, and wherein the leading edge foot blends out between and including a suction side crown and a throat plane on the suction side.

* * * * *